US006378610B2

(12) United States Patent
Rayssiguier et al.

(10) Patent No.: US 6,378,610 B2
(45) Date of Patent: Apr. 30, 2002

(54) COMMUNICATING WITH DEVICES POSITIONED OUTSIDE A LINER IN A WELLBORE

(75) Inventors: Chistophe M. Rayssiguier, Houston; Michael R. Johnson, Sugar Land; Ronald E. Pringle, Houston; John A. Booker, Missouri City; Alexandre G. E. Kosmala, Houston, all of TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/934,734

(22) Filed: Aug. 22, 2001

Related U.S. Application Data

(62) Division of application No. 09/528,334, filed on Mar. 17, 2000, now Pat. No. 6,302,203.

(51) Int. Cl.[7] ..... E21B 33/14

(52) U.S. Cl. ..... 166/281; 166/186; 166/194; 166/290; 166/382; 166/386; 166/387

(58) Field of Search ..... 166/285, 290, 166/281, 373, 381, 382, 386, 387, 186, 194

(56) References Cited

U.S. PATENT DOCUMENTS 4,281,711 A * 8/1981 Braddick et al.
4,287,949 A * 9/1981 Lindsey
4,391,325 A * 7/1983 Baker et al.
4,671,358 A * 6/1987 Lindsey et al.
4,688,642 A * 8/1987 Baker
4,712,614 A * 12/1987 Allwin et al.
4,828,037 A * 5/1989 Lindsey et al.
4,942,925 A * 7/1990 Themig

* cited by examiner

*Primary Examiner*—Roger Schoeppel
(74) *Attorney, Agent, or Firm*—Jeffrey E. Griffin; Jaime A. Castano

(57) ABSTRACT

A downhole string includes a liner and devices positioned outside the liner. One or more control lines extend from the liner devices along the exterior of the liner to one or more connectors that provide connection points inside the liner. The one or more connectors may include electrical connectors (e.g., direct contact connectors), inductive connectors (e.g., inductive couplers), optical connectors (e.g., fiber optic connectors), and hydraulic connectors. The one or more control lines may be electrical lines, fiber optic lines, or hydraulic lines. The downhole string may also be used with a cement protector during cementing operations to protect both the inside of the liner as well as the one or more connectors attached to the liner. The cement protector includes a sleeve that isolates cement from the inside of the liner during a cementing operation so that a liner wiper plug is not needed. The cement protector is engageable to a pulling tool that is attached to a running tool. The running tool in turn is connected to a pipe through which a cement slurry can be pumped. The cement slurry pumped through the inner bore of the pipe enters the sleeve of the cement protector. One or more ports are provided in the cement protector sleeve to enable communication of the cement slurry to an annulus region between the outer wall of the liner and the inner wall of the wellbore. If the apparatus and method is used with a casing, then a running tool may be omitted.

19 Claims, 8 Drawing Sheets

COMMUNICATING WITH DEVICES POSITIONED OUTSIDE A LINER IN A WELLBORE

This is a divisional of application Ser. No. 09/528,334 now U.S. Pat. No. 6,302,203 filed on Mar. 17, 2000.

BACKGROUND

The invention relates to communicating with devices positioned outside a liner in a wellbore.

Oil and gas wells may be completed with a variety of downhole devices to produce hydrocarbons from, or inject fluids into, formations beneath the earth surface. Completion equipment have been developed for many types of wells, including vertical or near-vertical, horizontal, deviated, and multilateral wells. Typical completion equipment include valves, tubing, packers, and other downhole devices, as well as electrical, optical, or hydraulic devices to monitor downhole conditions and to control actuation of downhole devices (e.g., opening or closing valves, setting packers, and so forth).

Sensors and control devices may also be mounted on or positioned outside of a liner, which is typically cemented to the wall of the wellbore. A special type of liner includes casing, which is a liner that extends to the well surface. A liner may also be connected below a casing to extend further into the wellbore or into a lateral branch of a multilateral well. One type of sensor that may be mounted on the outside of a casing includes resistivity electrodes, which are used to monitor the resistivity of a surrounding formation reservoir. Based on the resistivity information, various characteristics of the formation may be determined.

A conventional technique of communicating with the sensors mounted on the outside of casing includes running a control line outside the casing to the well surface. However, running one or more control lines in the cement layer creates a potential leak path to the well surface, which is undesirable. In addition, for liners that do not extend to the well surface, use of this technique may not be available. Another drawback of running a control line on the outside of the casing is that the control line may have to cross wellhead equipment at a relatively inconvenient location.

A need thus exists for a mechanism to provide communication with downhole sensors or control devices that are positioned outside of liners in a wellbore.

SUMMARY

In general, according to one embodiment, an apparatus for use in a well having a well surface and a wellbore lined with a liner includes one or more devices positioned outside the liner and one or more control lines connected to the devices and extending outside of the liner. One or more connectors are connected to the control lines and provide one or more connecting points accessible from inside the liner below the well surface.

Other embodiments and features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, a "liner" refers to any structure used to line the wall of any section of a wellbore, either in the main bore or in a lateral branch. Thus, "liner" may refer to either a liner or casing, which extends to the well surface.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate. Also, when used in a horizontal section of a wellbore, the terms "below" and "deeper" refer to a direction of the wellbore that is more distal from the wellbore surface.

Figure 1:
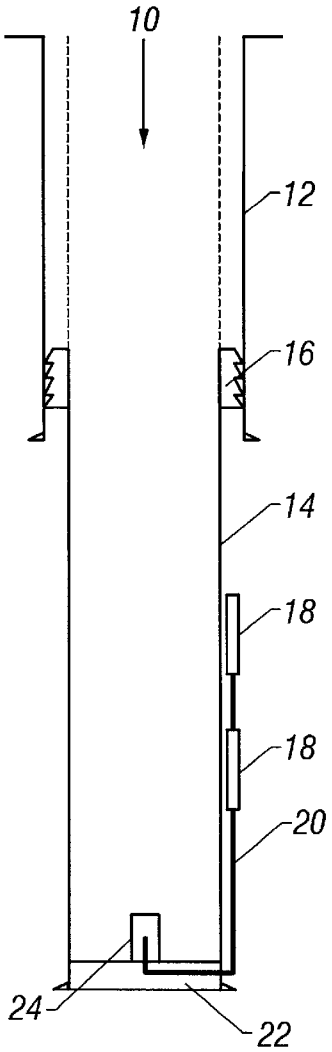
FIG. 1 illustrates an embodiment of a liner string in a wellbore, the liner string including a liner, devices positioned outside the liner, a control line connected to the devices, and a connector connected to the control line.

Referring to FIG. 1, a liner string according to one embodiment in a wellbore 10 is illustrated. An upper segment of the wellbore 10 is lined with casing 12. The liner string includes a liner 14 that lines a lower segment of the wellbore 10, with the liner 14 attached below a liner hanger 16 engaged to the inner wall of the casing 12. One or more control and/or monitoring devices 18 may be positioned outside the outer wall of the liner 14. In one arrangement, the control and/or monitoring devices may be mounted or attached to the outer wall of the liner 14. In another arrangement, the control and/or monitoring devices may be positioned outside the liner 14 but not in contact with the liner outer wall.

Such control and/or monitoring devices may include sensors (such as pressure and temperature gauges, resistivity electrodes, and so forth) to monitor wellbore or formation characteristics, and control elements (such as microcontrollers, microprocessors, or other electronic circuitry) to perform various control operations, such as opening valves, turning on or off sensors, and so forth. More generally, such control and/or monitoring devices may be referred to as "liner devices," which are downhole devices positioned or mounted outside of a liner. The liner devices may be electrical, hydraulic, optical, or other types of devices. One example of a liner device includes an array of resistivity electrodes that are used to create a resistive image of the surrounding formation reservoir to predict the arrival of water during production. In a different embodiment, the liner devices may be positioned outside the casing 12 instead of the liner 14.

In accordance with some embodiments, a control line 20 (or plural control lines) is connected to the liner devices 18. As illustrated, the control line 20 extends below the liner devices 18 deeper (or more distally) into the wellbore to the lower end of the liner 14. The control line 20 extends along the outside of the liner 14 and may be secured to the liner with protectors (usually at every coupling). At the lower end, a special liner shoe 22 is attached to the liner 14, with the control line 20 extending through the shoe 22. The shoe 22 may be connected to (or in the proximity of) a connector sub that includes a connector 24 (or plural connectors) connected to the control line 20. The combination of the connector sub and connector 24 is one example of a communication connector assembly. The connector assembly is accessible from within the liner 14. The connector 24 may be an electrical connector (e.g., a direct contact connector), an inductive coupler, an optical connector (e.g., a fiber optic connector), a hydraulic connector, or other connector. The control line 20 may be an electrical line, a fiber optic line, a hydraulic line, or other control line. The control line 20 is adapted to carry both telemetry and power signals.

In other arrangement, the connector does not need to be positioned at or in the proximity of the lower end of the liner 14 but may be positioned at another location along the liner. However, in such other arrangements, the connector is still positioned at a depth below the well surface so that the control line running from the liner devices to the connector does not compromise the seal provided by the cement layer surrounding the liner. Thus, a benefit offered by any arrangement in which the connector 24 is positioned below the well surface is that a connection mechanism to the liner devices is made available without having to run a control line in the cement layer all the way to the well surface, which may create an undersirable leak path. Also, this avoids having to run a control line through the liner hanger 16. Further, in the arrangement of FIG. 1, another benefit of positioning the connector 24 at or near the proximity of the lower end of the liner 14 is to avoid creating an obstruction in the inner bore of the liner 14 when other tool strings are run downhole. In the arrangements discussed, the connector 24 is positioned so that it can mate with a corresponding connector or other component run into the inner bore of the liner 14.

To install the liner string shown in FIG. 1 after the casing 12 has been installed in the wellbore 10, the liner string (including the liner 14, liner hanger 16, shoe 22, connector 24, control line 20, and liner devices 18) is run into the wellbore to the desired depth. Once positioned in the desired depth, the liner 14 is cemented in place. The cement is pumped (in slurry form) into the inner bore of the liner 14 and through the shoe 22 at the lower end to introduce the cement slurry into the annulus region between the outside of the liner and the inner wall of the wellbore 10. The introduced cement slurry flows upwardly in the annulus region to form the cement layer. The cement slurry is also flowed into a region 31 where the liner 14 and casing 12 overlap. Due to the absence of a control line running between the liner 14 and the casing 12, the cement in the region 31 between the liner 14 and the casing 12 provides a good seal to prevent wellbore fluids from leaking through the annulus between the outer wall of the liner 14 and the inner wall of the casing 12.

Figure 2A:
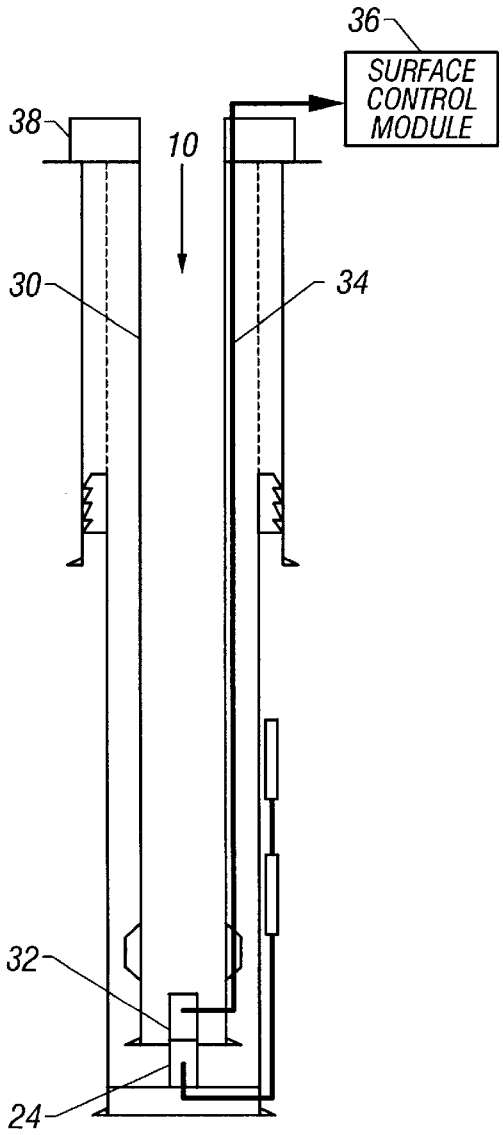
FIG. 2A illustrates an embodiment of a completion string for use with the liner string of FIG. 1, the completion string including a connector adapted to be mated to the liner string connector.

Referring to FIG. 2A, a completion string is run into the wellbore 10 after the liner string has been installed. In one example embodiment, the completion string includes a tubing 30, e.g., a production tubing, an injection tubing, or some other type of pipe. A connector 32 (or plural connectors) may be mounted at the lower end of the tubing 30. The connector 32 is adapted to connect to the connector 24 included in the connector sub of the liner string. The connector 32 may be an electrical, inductive, optical, hydraulic, or other connector.

The tubing connector 32 is in turn connected to a control line 34 (or plural control lines), which may be an electrical, optical, hydraulic, or other control line. The control line 34 runs along the outside of the tubing 30 to the well surface. In one arrangement, the control line 34 may be secured to the tubing 30 with protectors (usually at every coupling). At the well surface, the control line 32 extends through a tubing hanger 38 to a surface control module 36. The surface control module 36 may be a power supply and computer for electrical control lines, an optical sensor for fiber optic control lines, a hydraulic console for a hydraulic control line 24, another type of module, or a combination of the different consoles.

Centralizer mechanisms may be used to orient the connector 32 with respect to the liner connector 24 to help mate the connectors. If plural connectors are arranged in parallel, an orientation profile may be placed on the liner 14 above the liner connectors 24 so that a pin located on the tubing can orient the production string and position its connectors 32 to line up with the liner connectors 24.

Figure 2D:
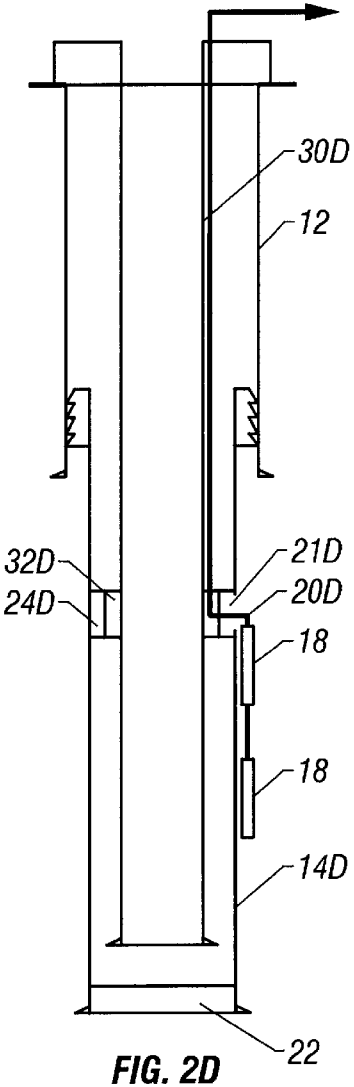
FIGS. 2B–2D illustrate other arrangements of liner strings and completion strings.
Figure 2C:
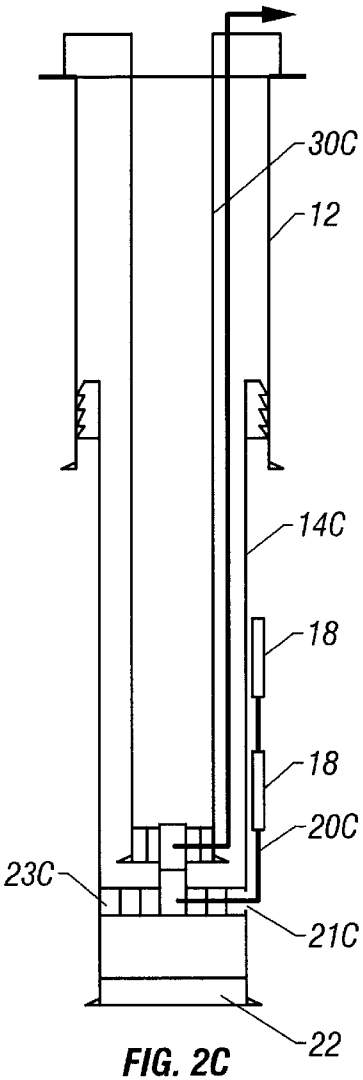
Figure 2B:
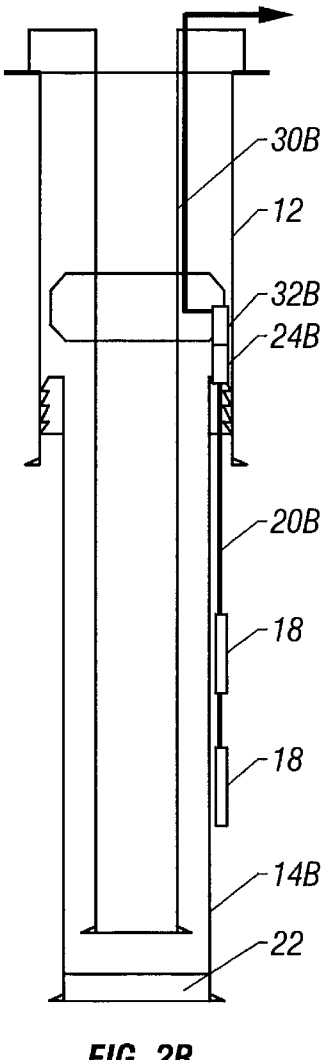

FIGS. 2B–2D illustrate different arrangements of the liner string and completion string. In the FIG. 2B example, a control line 20B extends outside the liner 14 to the upper end of the liner. At the upper end, the control line 20B reaches a connector sub 24B. The connector 24B is attached to the liner 14B and may be mated with the connector 32B of the tubing 30B.

Referring to FIG. 2C, in yet another arrangement, the control line 20C extends from the devices 18. In the example shown, the control line 20C extends through an opening 21C in the liner 14C. The control line 20C is then connected to a connector sub 23C inside the liner 14C. In another arrangement, the control line 20C may extend above the devices 18 instead of below the devices.

Referring to FIG. 2D, another arrangement has a control line 20D extending to an opening 21D in the liner 14D. The control line 20D is provided through the opening 21D to an annular connector 24D inside the liner 14D. The tubing 30D is attached to an annular connector 32D that is capable of mating with the connector 24D.

Other arrangements are also possible. For example, the connector on FIG. 2D may be placed on one side of the liner.

In accordance with a further embodiment of the invention, a cement protector may be used to protect the inner wall of the liner 14 during cementing operations. After the liner string is lowered to a desired depth, the liner 14 needs to be cemented to the wellbore wall. Conventionally, in performing a cementing operation, a cement slurry may be flowed inside the liner 14. To remove the cement from the inner bore of the liner 14 after the cementing operation has completed, a wiper plug may be used to wipe out the cement. The presence of the liner connector 24 may be incompatible with the use of cement or a wiper plug. The cement inside the inner bore or subsequent use of the wiper plug may also damage the connector 24.

The cement protector in accordance with some embodiments may be used to isolate the cement from the inner wall of the liner 14 and the connector 24 during a cementing operation. This reduces the likelihood that connector 24 and the inner wall of the liner are damaged during the cementing operation.

By not polluting the inside of the liner with cement, use of a wiper plug can be avoided, which can reduce the number of runs needed to perform a cementing operation to as little as a single run. A safe operation is provided since the cement protector may be retrieved to the well surface before the cement dries. In an alternative arrangement, the cement protector may be a cover that isolates cement from the connector 24 but not necessarily the liner 14.

Figure 3:
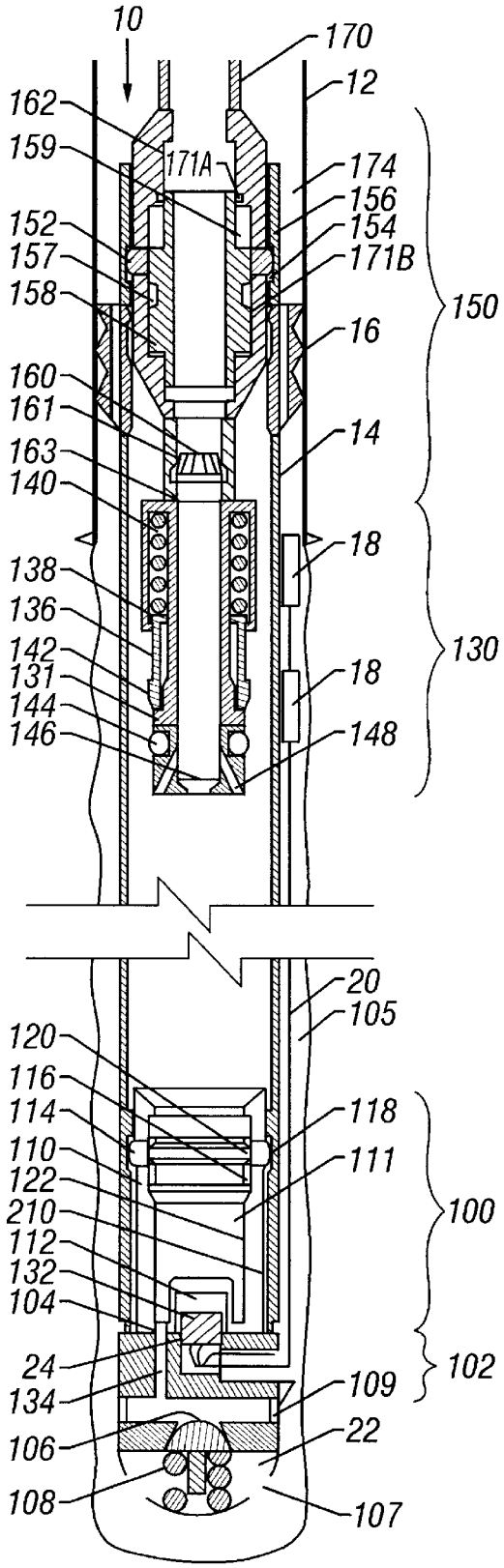
FIG. 3 illustrates an embodiment of a string cooperable with the liner string of FIG. 1 to perform cementing operations in accordance with an embodiment.

Referring to FIG. 3, a tool string that includes a cement protector 100 in accordance with one embodiment is illustrated. The liner string shown in FIG. 1 including the casing 12, liner hanger 16, liner 14, connector(s) 24, liner shoe 22, control line(s) 20, and liner devices 18, is also illustrated in FIG. 3. The cement protector 100 is positioned above a connector sub 102 that includes the connector(s) 24. The connector sub 102 is located above the liner shoe 22, which includes a check valve 106 that is pushed by a spring 108 to an upward and sealed position against a seat member 109. Plural check valves may be used for redundancy. During cementing operations, a cement slurry applied under pressure pushes the check valve 106 away from the seat member 109 to allow the cement slurry to flow through openings 107 into an annulus region 105 between the outside of the liner 14 and the inner wall of the wellbore 10.

The cement protector 100 includes a sleeve 110 with an inner bore 111. The bottom of the cement protector 100 provides a cover or cap that defines a chamber 112 which may be filled with a clean fluid such as grease or dielectric oil to protect the connector(s) 24 from pollution by cement or debris.

One or more ports 132 are provided at the lower end of the cement protector sleeve 110 to allow outflow of cement slurry from the inner bore 111 of the cement protector sleeve 110. One or more corresponding conduits 134 are provided in the connector sub 134. The one or more fluid flow paths provided by the one or more ports 132 and the one or more conduits 134 enable the communication of cement slurry to the shoe 22. Seals 104 may be provided around the one or more ports 132 and conduits 134 to prevent communication of cement slurry with any part of the inner bore of the liner 14.

The cement protector 100 also includes a locking device that includes locking dogs 114 and a locking sleeve 116. The locking device releasably engages the cement protector 100 to the liner 14. The locking dogs 114 are positioned in corresponding windows in the cement protector sleeve 110. A shearing mechanism (not shown) may be used to fix the locking sleeve 116 in place until a sufficient force is applied to move the locking sleeve 116 upwardly to release the locking dogs 114. This translation opens a bypass orifice (not shown) cut into the protector sleeve 110, so that any differential pressure can be equalized before removing the cement protector 100. In the illustrated position of FIG. 3, the locking dogs 114 are held in position by the locking sleeve 116 inside a groove 118 formed in the inner wall of the liner 14.

A recess 120 is provided in the locking sleeve 116. The recess 120 is adapted to engage a pulling tool 130 so that the cement protector 100 may be retrieved from the wellbore after the cementing operation is complete. The cement protector 100 also includes a seal bore 122 that allows the pulling tool 130 to sealingly engage the inner bore of the cement protector sleeve 110.

The pulling tool 130 includes elements to engage corresponding elements of the cement protector 100 so that upward movement of the pulling tool 130 pulls the cement protector 100 upwardly. The lower end of the pulling tool 130 includes a seat 146 for a ball that may be dropped from the well surface. In addition, one or more angled conduits 148 are provided in the housing 131 of the pulling tool 130 to enable communication between the inside of the pulling tool 130 and the outside when the ball is positioned in the seat 146. A groove is also formed in the pulling tool housing 131 to carry a seal 144, which may be an O-ring or V-packing seal assembly, that is adapted to engage the seal bore 122 of the cement protector 100.

Fingers 136 are provided on the outside of the pulling tool 130. The lower ends of the fingers 136 include protruding portions 142. The combination of each finger 136 and protruding portion 142 forms a collet. In the illustrated position, the inner surfaces of the protruding portions 142 abut on the pulling tool housing 131. The upper end 138 of the fingers 136 are engaged to a coiled spring 140. The coiled spring 140 is contained inside a chamber defined by the pulling tool housing 131.

An upward force applied on the fingers 136 may move the fingers 136 upwardly against the spring 140. When the protruding portions 142 have moved up a sufficient distance to a recessed section of the pulling tool housing 131, the protruding portions 142 may be collapsed radially inwardly. The ability to collapse the protruding portions 142 enable the protruding portions 142 to engage the recess 120 of the locking sleeve 116 in the cement protector 100.

As an option, the pulling tool body 110 may be equipped with spring-energized keys (not shown). These keys can expand into slots cut into the top of the orienting profile 210. In this way, a torque applied to the running string at the surface can be transmitted to the liner, if desired.

Attached above the pulling tool 130 is a running tool 150. The running tool 150 is attached below a tubing or pipe 170 and includes a mechanism for releasably securing the running tool 150 to the liner 14. Collectively, the pipe 170, running tool 150, and pulling tool 130 make up an example of a running string. The running tool 150 is adapted to be released once the liner hanger 16 is engaged to the casing 12. Effectively, the running string is releasably attached proximal an upper end of the liner 14 when the liner string is being run in.

The running tool 150 includes dogs 152 that are fitted through openings in the running tool housing 162 to engage slots 154 formed in a nipple 156 connected to the liner hanger 16. Torque can be applied to the running string for transmission to the liner if needed. The dogs 152 are maintained in position by a locking sleeve 158 in the running tool 150. The locking sleeve 158 is capable of translating longitudinally inside the running tool housing, but is fixed in position by a shearing mechanism (not shown).

The running tool 150 also provides a seat 160 for a ball that can be dropped from the well surface. The ball sealingly engages the seat 160 so that pressure may be increased inside the running tool 150 above the ball. This pressure increase creates a differential pressure across the locking sleeve 158, which is equipped with two different seals 171A and 171B on the two sides of a chamber 159. If a sufficient force is applied by the differential pressure, the shearing mechanism of the locking sleeve 158 breaks to allow translation of the locking sleeve 158 to free the dogs 152 into the sleeve groove 157.

The ball seat itself 160 may be locked in position by a shearing mechanism (not shown) having a larger shear strength than the locking sleeve 158 shearing mechanism. Once a sufficient force is applied to shear the shearing mechanism of the ball seat 160, the ball seat 160 can be moved downwardly until it impacts an inner shoulder 163 of the pulling tool housing 131. At this point, the force applied against the ball can push the upper ring 161 of the ball seat 160 outwardly so that the ball 200 can pass through the ball seat 160. Then the ball 200 drops into the pulling tool 130 to sit in the seat 146, pushed by the differential pressure. In another embodiment, the two seats 161 and 146 can be combined. The seat 146 in this other embodiment can be cut in a sliding sleeve locked in place by a shearing mechanism. The translation of this sleeve may open the conduits 148.

FIGS. 4A–4I illustrate a sequence of operations including installation of the liner string of FIG. 1, a cementing operation, and installation of a completion string inside the liner string after the cementing operation.

Figure 4A:
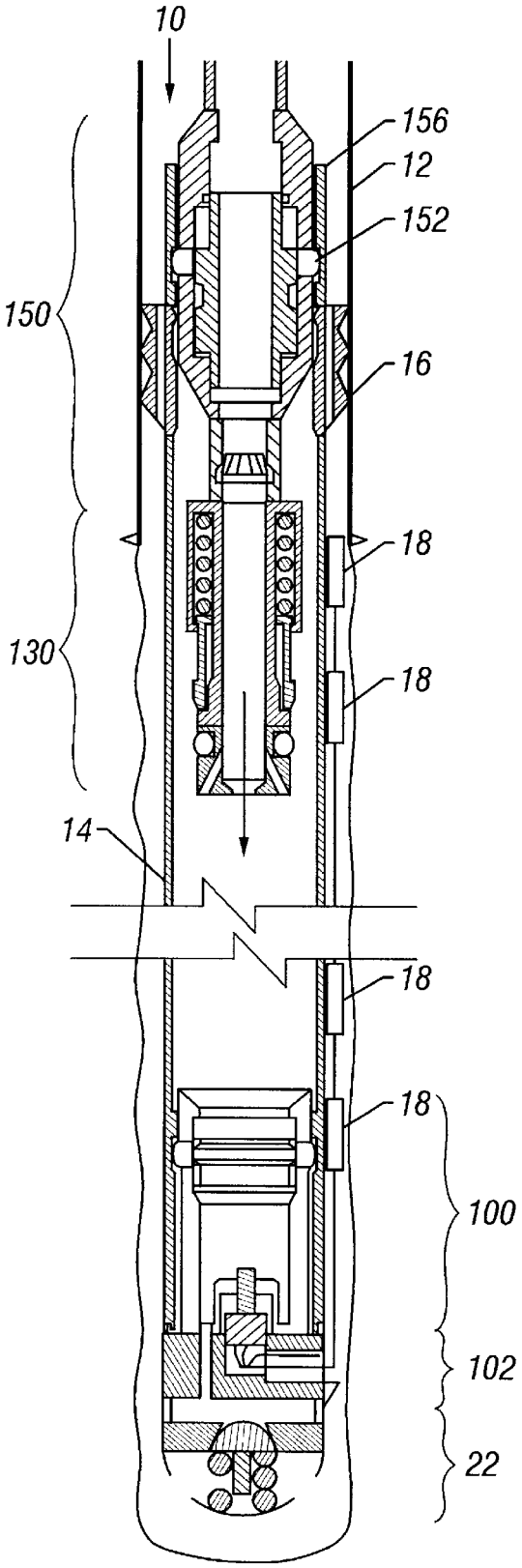
FIGS. 4A–4I illustrate a sequence of operations involving the string of FIG. 3, the liner string of FIG. 1, and a completion string.
Figure 4B:
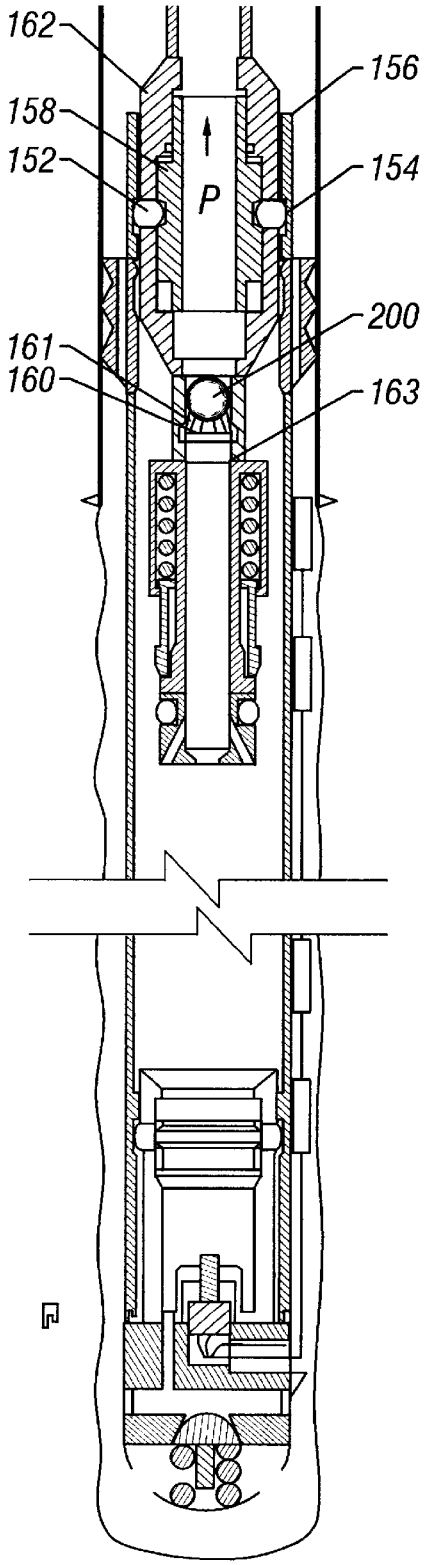

In FIG. 4A, the liner string of FIG. 1 (including the liner, liner hanger, liner devices, control line, and connector) along with the tool string of FIG. 3 are run together into the wellbore 10. As shown, the running tool 150 is connected by the dogs 152 to the nipple 156 connected to the liner hanger 16. Once the liner hanger 16 has been set against the inner wall of the casing 12, a ball 200 can be dropped to sealingly engage a seat 160 in the running tool 150, as shown in FIG. 4B. An applied elevated pressure inside the pipe 170 attached to the running tool 150 creates a differential pressure across the locking sleeve 158. If a sufficient differential pressure is created, the force applied on the locking sleeve 158 causes breakage of the shearing mechanism and upward movement of the locking sleeve 158. A groove 157 of the locking sleeve 158 allows the locking dogs 152 to drop away from the recess 154 of the nipple 156 when the locking sleeve 158 has moved upwardly by a sufficient distance. This causes the running tool 150 to disengage from the nipple 156, as shown in FIG. 4B.

Figure 4C:
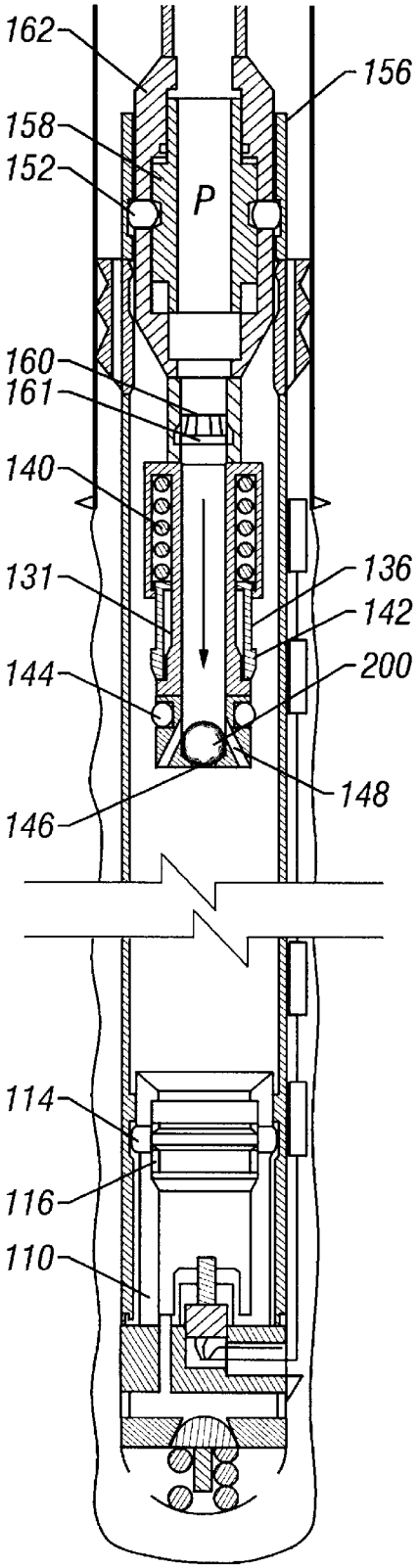

Once the dogs 152 are disengaged, a further increase in the differential pressure across the ball 200 sitting in the seat 160 may shear the shearing mechanism attaching the ball seat 160 to the running tool 150. The ball seat 160 then translates downwardly to impact the shoulder 163 of the pulling tool housing 131. At this point, the force applied against the ball 200 can push the upper ring 161 of the ball seat 160 outwardly so that the ball 200 can pass through the ball seat. The ball 200 drops into the pulling tool 130 to sit in the seat 146 of the pulling tool, as shown in FIG. 4C. The running string including the pipe 170, the running tool 150, and the pulling tool 130 is then lowered to engage the pulling tool 130 inside the cement protector 100. If the liner devices are positioned outside the casing 12 instead of the liner 14, then the running tool 150 may be omitted.

Figure 4D:
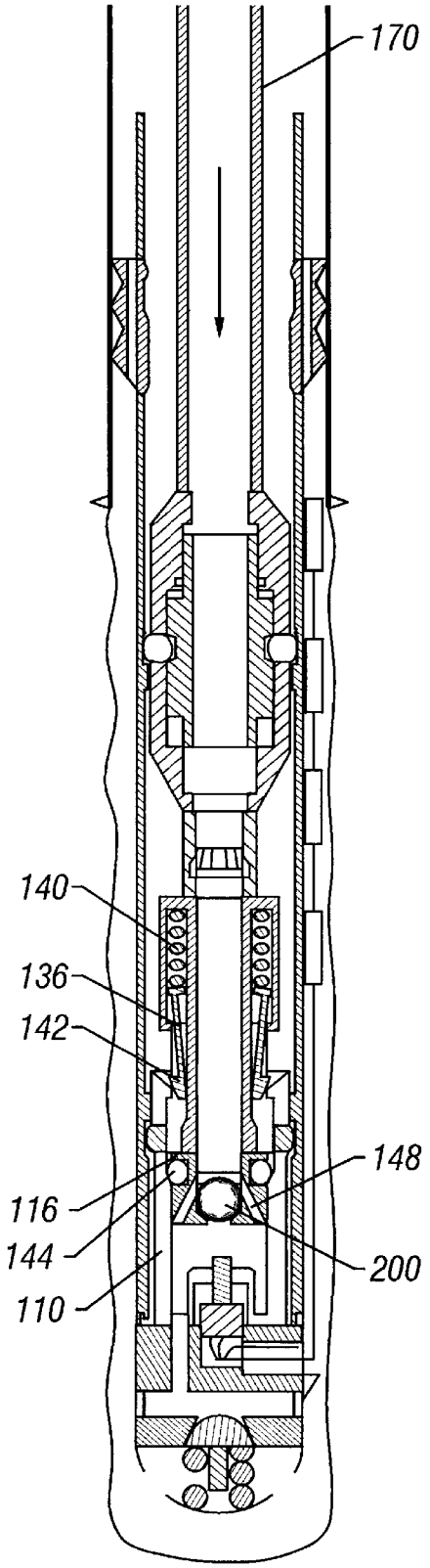
Figure 4E:
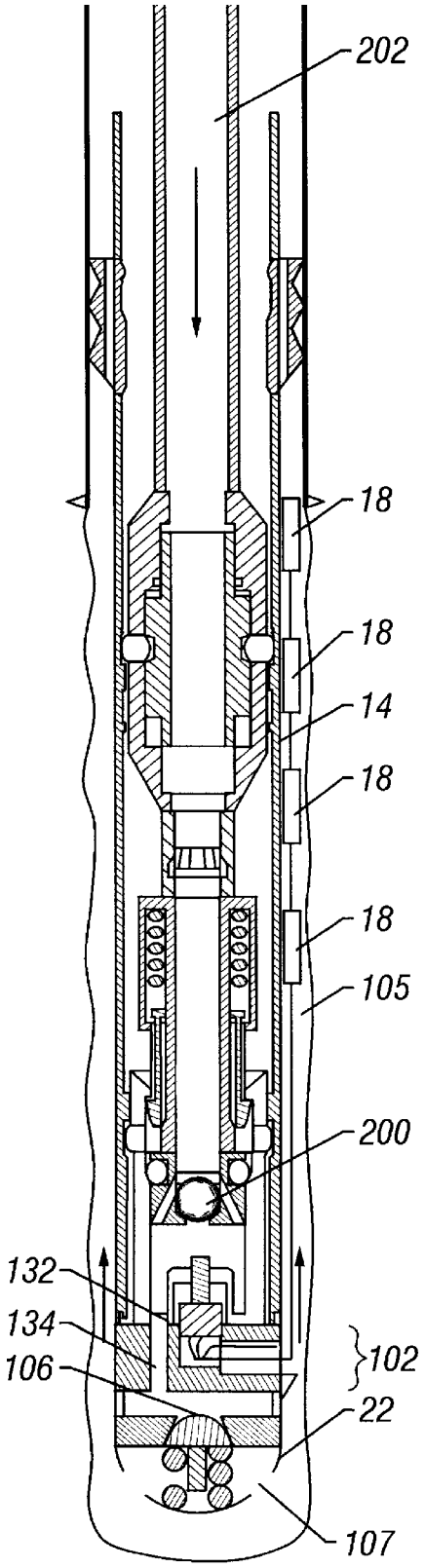

As shown in FIG. 4D, as the pulling tool 130 is lowered into the cement protector sleeve 110, the fingers 136 are pushed upwardly and radially collapsed by abutment with the upper end of the cement protector sleeve 110. As the pulling tool 130 is pushed further into the cement protector sleeve 110, the seals 144 carried by the pulling tool 130 are sealingly engaged in the seal bore 122 of the cement protector sleeve 110, as shown in FIG. 4E. Also, the protruding portions 142 of the fingers 136 are engaged in the recess 120 of the locking sleeve 116.

When running in, the running string is releasably attached to an upper end of the liner string to avoid two generally concentric tubular structures (the liner 14 and the pipe 170) traversing a large distance together, which may greatly increase the weight of the run-in assembly. Instead, according to some embodiments, the running string is moved downwardly from the upper end of the liner string to the lower end to engage the cement protector 100 after the liner hanger 16 is set.

More generally, the running string may be replaced with any type of run-in tool, and the cement protector 100 may be replaced with any type of run-in receiver. The general concept is that the run-in tool lowers a liner or some other downhole structure into the wellbore, followed by releasing the run-in tool. Next, the run-in tool is lowered into the wellbore until it is received by the run-in receiver or coupled to the liner 14.

Figure 4F:
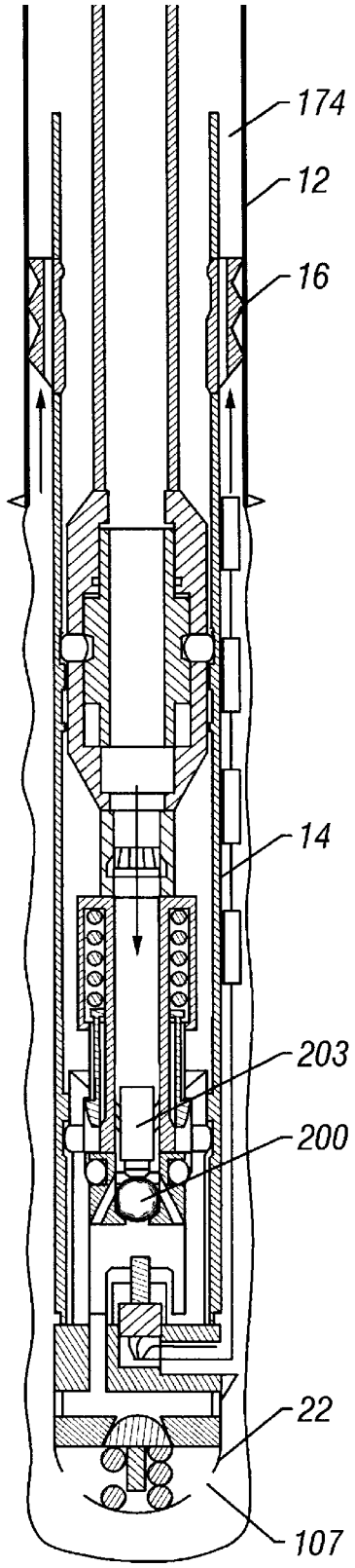

When the pulling tool 130 is engaged in the cement protector sleeve 110, fluid communication is provided between the inside of the running string 170 and the inside of the cement protector sleeve 110 through the angled conduits 148. As further shown in FIG. 4E, the cementing operation is started, in which a cement slurry 202 is pumped through the angled conduits 148 of the pulling tool 130 into the inner bore of the cement protector sleeve 110. The cement slurry is pumped by downward movement of a cement plug 203 (not shown in FIG. 4E but shown in FIG. 4F). As elevated pressure is applied above the plug 203 to supply the downward movement. The cement slurry flows through the ports 132 of the cement protector 100 and conduits 134 of the connector sub 102 into the liner shoe 22 through the check valve 106. The cement slurry continues through liner shoe openings 107 into the annulus region 105 between the outer wall of the liner 14 and the inner wall of the wellbore 10. As shown in FIG. 4F, the cement slurry continues up an annulus region 174 between the outside of the liner 14 and the inside of the casing 12. The cementing operation may be stopped once the plug 203 contacts the ball 200. The cement between the outside of the liner 14 and the inside of the casing 12 provides a relatively good seal to prevent leakage of wellbore fluids up the annulus region between the liner and casing.

Figure 4G:
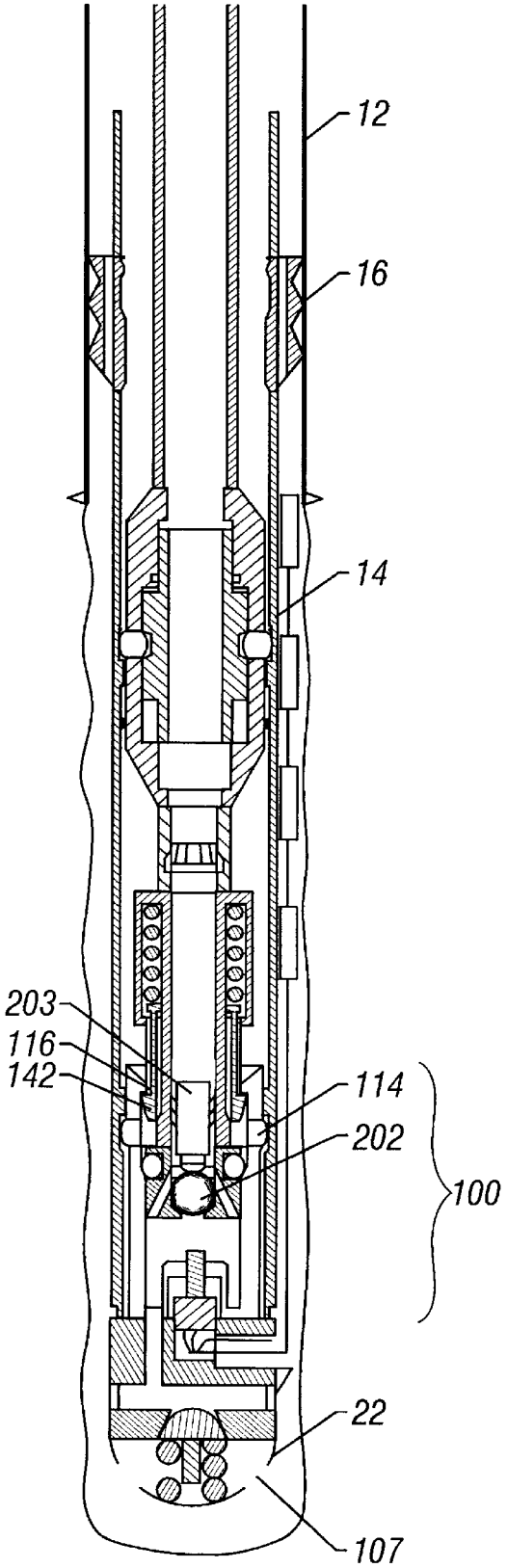
Figure 4H:
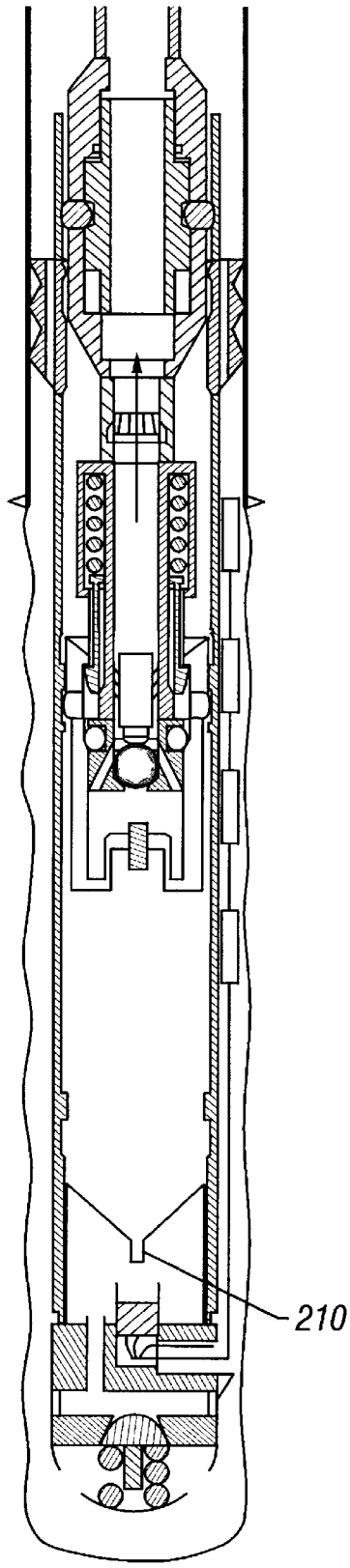

After the cementing operation has been completed, the running string may be pulled out of the wellbore 10. As shown in FIG. 4G, an upward shifting of the running string causes the protruding portions 142 of the fingers 136 to pull upwardly on the locking sleeve 116 of the cement protector. Upward movement of the locking sleeve 116 enables release of the locking dogs 114 so that the cement protector 100 is released from the liner 14. At this point, the running string and cement protector 100 may be pulled out of the wellbore, as shown in FIG. 4H. The cement protector 100 may be easily retrieved before the cement has dried. As the cement protector 100 is retrieved, the cement remains inside the cement protector sleeve 110, with the inner wall of the liner 14 remaining substantially clear of cement. It is noted that some leakage of cement may flow into the inner bore of the liner 14. However, the amount of such leakage may be small enough so that a subsequent cleaning operation is not needed.

Figure 4I:
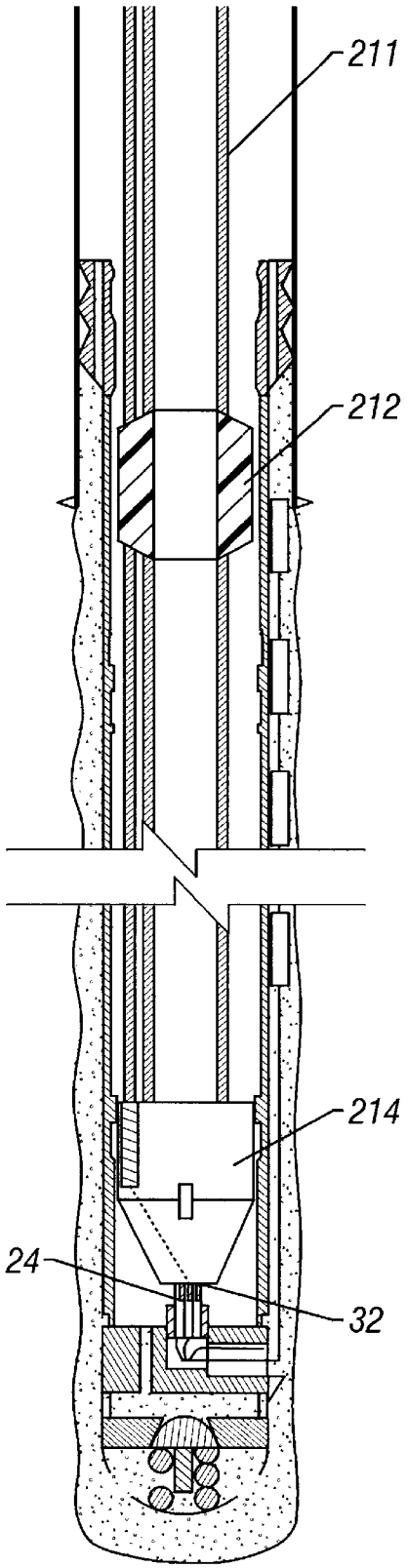

As further illustrated in FIG. 4H, an orienting profile 210 is provided in the inner wall of the liner 14 to allow alignment of connector(s) of the completion string with the connector(s) of the liner 14. Next, as shown in FIG. 4I, the completion string, including a flow control device 212 (in one example embodiment) and a connector sub 214, may be run into the wellbore. The connector sub 214 is oriented by the orienting profile 210 to align the connector(s) 32 to the liner connector(s) 24.

In accordance with some embodiments, downhole components have been described to enable connection between devices positioned outside of a liner and components inside the liner. This may be accomplished by running one or more control lines from the liner devices to one or more connectors that provide connection points inside the liner below the well surface. The one or more connectors may include electrical connectors (e.g., direct contact connectors), inductive connectors (e.g., inductive couplers), optical connectors (e.g., fiber optic connectors), hydraulic connectors, or other connectors. The one or more control lines may be electrical lines, fiber optic lines, hydraulic lines, or other control lines.

In accordance with further embodiments, a cement protector may be used during cementing operations to protect both the inside of the liner as well as the one or more connectors attached to the liner. The cement protector includes a sleeve that isolates cement from the inside of the liner during a cementing operation. The cement protector is engageable to a pulling tool that is attached to a running tool. The running tool in turn is connected to a pipe through which a cement slurry can be pumped. The cement slurry pumped through the inner bore of the pipe enters the sleeve of the cement protector. One or more ports are provided in the cement protector to enable communication of the cement slurry to an annulus region between the outer wall of the liner and the inner wall of the wellbore.

While the invention has been disclosed with respect to a limited number of embodiments, those skilled in the art will appreciate numerous modifications and variations therefrom. It is intended that the appended claims cover all such modifications and variations as fall within the true spirit and scope of the invention. For example, instead of using locking dog assemblies in the described attachment mechanisms, other releasable attachment mechanisms may be used, such as those including collets. Also, instead of using a ball dropped from the well surface to create isolation for generating an elevated pressure, a valve (e.g., a ball valve) may be used instead.

What is claimed is:

1. An apparatus for use in a wellbore having a liner with an inner bore, comprising:

a cement protector to prevent or reduce communication of cement into the liner inner bore during a cementing operation, the cement protector including a sleeve and one or more ports; and a running string attached to the cement protector, the running string adapted to communicate cement through the one or more cement protector ports to a region outside the liner.

2. The apparatus of claim 1, wherein the cement protector further includes a locking device to releasably engage the cement protector to the liner.

3. The apparatus of claim 2, wherein the cement protector further includes a profile, wherein the running string is adapted to engage the profile to release the locking device to enable retrieval of the cement protector.

4. The apparatus of claim 3, further comprising a connector sub including one or more connectors, the cement protector defining a chamber in communication with the one or more connectors to isolate cement from the one or more connectors.

5. The apparatus of claim 4, wherein the chamber is filled with a fluid to protect the one or more connectors.

6. The apparatus of claim 4, wherein the one or more connectors each includes a connector selected from the group consisting of an electrical connector, an inductive coupler, an optical connector, and a hydraulic connector.

7. The apparatus of claim 1, wherein the running string includes a running tool releasably engaged to the liner.

8. The apparatus of claim 7, wherein the liner is part of a liner string that further includes a liner hanger and a nipple, the running tool being releasably attached to the nipple.

9. The apparatus of claim 7, wherein the running string is moveable longitudinally upon release to engage the cement protector.

10. The apparatus of claim 7, wherein the running tool includes a ball seat to receive a ball, the running tool including an inner bore and a locking device to releasably engage the liner, the locking device adapted to be released by an increase in pressure in the running tool inner bore after the ball is sealingly engaged in the ball seat.

11. The apparatus of claim 10, wherein the ball seat is releasably attached to a housing of the running tool, wherein a further increase in pressure causes the ball seat to be released and to enable the ball to drop through the ball seat.

12. The apparatus of claim 11, wherein the running string further includes a second ball seat below the first ball seat, the second ball seat adapted to receive the ball after the ball drops through the first ball seat.

13. The apparatus of claim 12, wherein the running string further includes one or more ports to enable fluid communication between the inside and outside of the running string after the ball has dropped into the second ball seat.

14. A method of completing a well having an inner wall, comprising:

running a liner string including a liner having an inner bore into the wellbore;

running a cement protector into the liner; and introducing a cement slurry into the wellbore, the cement slurry communicated through the cement protector to an annulus between the liner and the wellbore inner wall, the cement protector isolating the cement slurry from the liner inner bore.

15. The method of claim 14, wherein running the liner string and running the cement protector are performed in the same run.

16. The method of claim 14, wherein running the liner string includes running the liner string releasably attached to a running string.

17. The method of claim 16, further comprising releasing the running string and moving the running string to engage the cement protector.

18. The method of claim 17, wherein introducing the cement slurry includes introducing the cement slurry through the running string.

19. The method of claim 18, further comprising retrieving the running string and cement protector after the cementing operation.

* * * * *